US009605510B2

(12) United States Patent
Grainger

(10) Patent No.: US 9,605,510 B2
(45) Date of Patent: Mar. 28, 2017

(54) NON-ROTATING CONNECTOR FOR WELLBORE CEMENTING TOOL

(71) Applicant: Robert Grainger, Regina (CA)

(72) Inventor: Robert Grainger, Regina (CA)

( * ) Notice: Subject to any disclaimer, the term of this patent is extended or adjusted under 35 U.S.C. 154(b) by 0 days.

(21) Appl. No.: 14/314,412

(22) Filed: Jun. 25, 2014

(65) Prior Publication Data

US 2016/0201428 A1 Jul. 14, 2016

(51) Int. Cl.

| | |
|---|---|
| ***E21B 33/13*** | (2006.01) |
| ***E21B 23/01*** | (2006.01) |
| ***E21B 23/02*** | (2006.01) |
| ***E21B 33/14*** | (2006.01) |

(52) U.S. Cl.

CPC ..... *E21B 33/13* (2013.01); *E21B 23/01* (2013.01); *E21B 23/02* (2013.01); *E21B 33/14* (2013.01)

(58) Field of Classification Search

CPC ..... E21B 23/01; E21B 23/02; E21B 33/128; E21B 33/13; E21B 33/14; E21B 33/129; E21B 34/14

See application file for complete search history.

(56) References Cited

U.S. PATENT DOCUMENTS 1,804,818 A * 5/1931 Spang ..... E21B 33/128 166/118
3,706,342 A * 12/1972 Woolley ..... E21B 23/06 166/134
5,048,613 A * 9/1991 Shilling ..... E21B 23/06 166/123
5,358,048 A * 10/1994 Brooks ..... E21B 33/127 166/285
6,142,227 A * 11/2000 Hiorth ..... E21B 33/129 166/123
7,389,823 B2 * 6/2008 Turley ..... E21B 33/134 166/134
9,441,450 B2 * 9/2016 Grainger ..... E21B 23/01
2003/0132007 A1 * 7/2003 Howlett ..... E21B 47/1025 166/387
2005/0194143 A1 * 9/2005 Xu ..... E21B 43/10 166/285

(Continued)

*Primary Examiner* — Daniel P Stephenson

(74) *Attorney, Agent, or Firm* — Ascus IP Law, PC; Colin Rasmussen

(57) ABSTRACT

A wellbore cementing tool configured for placement in a wellbore or in a drill string, and method of using same. The tool comprises a body having upper and lower members connected by a shear component. A rod is connected to the upper member, and the tool can be lowered with the rod into the wellbore or drill string to a desired depth. At the desired depth, locking means are deployed to lock the tool in position, the tool is sealed, and cement can be injected through the tool to the annulus of the outer casing. In some embodiments the tool is locked using a pushing motion that extends locking members outwardly from the tool to engage the wellbore walls or the inner surfaces of the drill string. Once cementing is completed, the rod is pulled from surface thereby causing the shear component to rupture and the upper and lower members to disconnect, and the upper member can be drawn to surface leaving the rest of the tool downhole. The tool does not require rotation to recover the rod, hence reducing the risk of loosening the threaded connections of lengths of drill pipe.

18 Claims, 5 Drawing Sheets

(56) References Cited

U.S. PATENT DOCUMENTS

| | | | | |
|---|---|---|---|---|
| 2009/0107675 | A1* | 4/2009 | Eriksen | E21B 7/20 166/285 |
| 2011/0011575 | A1* | 1/2011 | Nguyen | E21B 23/01 166/87.1 |
| 2012/0085539 | A1* | 4/2012 | Tonnessen | E21B 23/01 166/298 |
| 2013/0264068 | A1* | 10/2013 | Hanson | E21B 21/103 166/373 |
| 2014/0083697 | A1* | 3/2014 | Grainger | E21B 23/01 166/285 |
| 2014/0338889 | A1* | 11/2014 | Grainger | E21B 23/01 166/179 |
| 2015/0159449 | A1* | 6/2015 | Moyes | E21B 33/134 166/217 |
| 2016/0017686 | A1* | 1/2016 | Ferg | E21B 33/13 166/290 |
| 2016/0138361 | A1* | 5/2016 | Clemens | E21B 29/10 166/387 |
| 2016/0201428 | A1* | 7/2016 | Grainger | E21B 23/02 166/290 |

* cited by examiner

NON-ROTATING CONNECTOR FOR WELLBORE CEMENTING TOOL

FIELD OF THE INVENTION

The invention relates to wellbore drilling technology, and specifically to tools and methods for cementing in a wellbore.

BACKGROUND OF THE INVENTION

In the practice of borehole or wellbore drilling, a rotary drilling apparatus is employed to drill a hole downwardly into the ground, normally to either determine subsurface conditions, obtain samples of subsurface materials, or to extract natural resources located at depth. It is known to inject specialized cementitious material into the borehole to stabilize the hole walls or allow for isolation of certain subsurface strata.

Various cementing tools and methods have been developed over the years, often for mining or oil and gas drilling applications. While they have achieved generally widespread use and acceptance, it is known that certain drilling tools manifest potentially disadvantageous features. For example, some drilling tools are intended for deployment at a certain depth in the borehole, but locking them in place at that desired depth and then attempting to recover the string or stem used to place the tool may require rotation of the tool and/or the string or stem, with the risk that threaded sections of drill pipe—in which the tool is being deployed—may be loosened at depth, a potentially serious occurrence. Also, some cementing tools can only be positioned when the drill string has first been removed from the hole, a practice known as tripping out the drill string. Tripping out the drill string can be time consuming and, in some contexts, otherwise unnecessary or undesirable.

It would therefore be desirable to have a wellbore cementing tool that could be employed without tripping out the drill string or requiring rotation that might destabilize the string in place.

SUMMARY OF THE INVENTION

The present invention therefore seeks to provide a wellbore cementing tool and method for using same, where the tool can be deployed within an in-place drill string and locked in place at a desired depth, and the string or stem recovered without requiring tool rotation.

According to a first aspect of the present invention there is provided a tool for use in cementing a wellbore, the tool comprising: a body, the body comprising upper and lower members; a passage for receiving and guiding cementitious material through the tool; locking means configured to secure the tool within the wellbore when deployed; the upper and lower members connected by means of a shear component, the shear component configured to rupture and allow disconnection of the upper and lower members; and the upper member configured for engagement with a rod for lowering the tool into place in the wellbore; wherein after deployment of the locking means, lifting of the upper member by means of the rod causes the shear component to rupture and the upper and lower members to disconnect, allowing the upper member to be disconnected without rotating the tool and removed from the wellbore.

In some exemplary embodiments of the first aspect of the present invention, the tool further comprises an outer sleeve slidably disposed on the tool, wherein the locking means comprise outwardly-biased locking members configured to engage an inner surface of the wellbore, the outer sleeve comprising apertures configured to selectively align with the locking members; wherein the outer sleeve is movable from a first downwardly disposed position to a second upwardly disposed position when the tool is lowered into the wellbore and contacts a downhole obstacle; wherein the apertures and the locking members are out of alignment when the outer sleeve is in the first position, such that the locking members are held in a disengaged position by the outer sleeve; and wherein the apertures and the locking members are aligned when the outer sleeve is in the second position, such that the locking members extend through the apertures for engagement with the inner surface of the wellbore, thereby securing the tool in the wellbore. The downhole obstacle may be a drill bit and the locking members are then configured to engage inner surfaces of a drill string within the wellbore. The tool may further comprise a locking component, wherein the locking members are pivotally mounted on the locking component. The outer sleeve may comprise an upper sleeve and a lower sleeve separated by a sleeve shear pin, the sleeve shear pin configured to rupture when the lower sleeve contacts the downhole obstacle and thereby allow upward movement of the upper sleeve into the second position, and may further comprise a deformable sleeve disposed between the upper sleeve and the lower sleeve, the deformable sleeve configured to move outwardly toward the inner surface of the wellbore for sealing engagement therewith when the upper and lower sleeves move upwardly into the second position.

The passage may be disposed at least partly within the body, and preferably comprises at least one opening extending to an area external to the tool for release of cementitious material into the area. The tool may further comprise a backflow preventer to prevent backflow of cementitious materials through the at least one opening into the passage. The rod may be hollow for supplying cementitious material to the passage, and the upper member can be configured to receive and retain a plug to terminate supply of the cementitious material to the passage.

Preferably, the upper member comprises a downwardly projecting portion, the lower member comprises an upwardly projecting portion, and the shear component comprises a body shear pin passing through the downwardly projecting portion and the upwardly projecting portion. The tool may further comprise a housing, the upper and lower members disposed within the housing, the upper member secured within the housing by means of a housing shear pin, the housing shear pin configured to rupture when the shear component ruptures and the upper and lower members are disconnected.

In some exemplary embodiments, the lower member is secured in a first position by the shear component when unruptured and biased toward a second position by biasing means; wherein when the lower member is in the first position the passage is unblocked by the lower member; and wherein when the shear component ruptures the lower member moves to the second position and the passage is blocked by the lower member, thereby blocking flow of the cementitious material.

According to a second aspect of the present invention there is provided a method for cementing a wellbore, wherein the method comprises the steps of: providing a tool comprising a body, a passage and locking means, the body comprising upper and lower members connected by a shear component; connecting a rod to the upper member; lowering the tool into the wellbore by means of the rod connected to the upper member; securing the tool at a desired depth within the wellbore by means of the locking means; injecting cementitious material through the passage, such that the cementitious material passes out of the tool and into the wellbore; pulling up on the rod to lift the upper member, causing the shear component to rupture and the upper and lower members to disconnect without rotating the tool; and removing the upper member from the wellbore.

In some exemplary embodiments of the second aspect of the present invention, the tool is lowered into a drill string in the wellbore, such that the locking means engage inner surfaces of the drill string and the cementitious material passes through the tool and out of the drill string and travels upwardly in the annulus between the drill string and the wellbore.

In further embodiments, the method comprises the further step after injection of cementitious material of inserting a plug into the upper member to prevent further cementitious material from entering the passage.

In yet further embodiments, the method further comprises biasing the lower member toward a second position but securing the lower member in a first position by the shear component when unruptured, whereas in the first position the passage is unblocked by the lower member, the method further comprising the step after rupture of the shear component of allowing the lower member to move to the second position and block the passage thereby blocking flow of the cementitious material.

A detailed description of an exemplary embodiment of the present invention is given in the following. It is to be understood, however, that the invention is not to be construed as being limited to this embodiment.

BRIEF DESCRIPTION OF THE DRAWINGS

In the accompanying drawings, which illustrate an exemplary embodiment of the present invention.

An exemplary embodiment of the present invention will now be described with reference to the accompanying drawings.

DETAILED DESCRIPTION OF EXEMPLARY EMBODIMENT

Figure 1A:
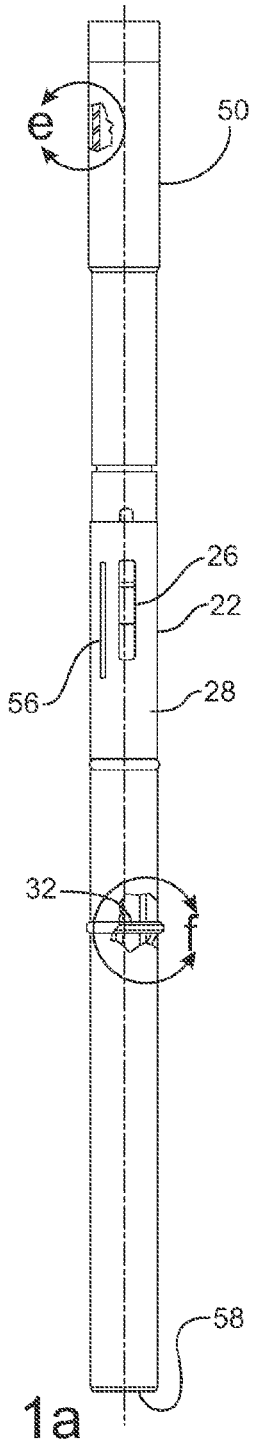
FIG. 1*a* is an elevation view of a tool according to the present invention.
Figure 1B:
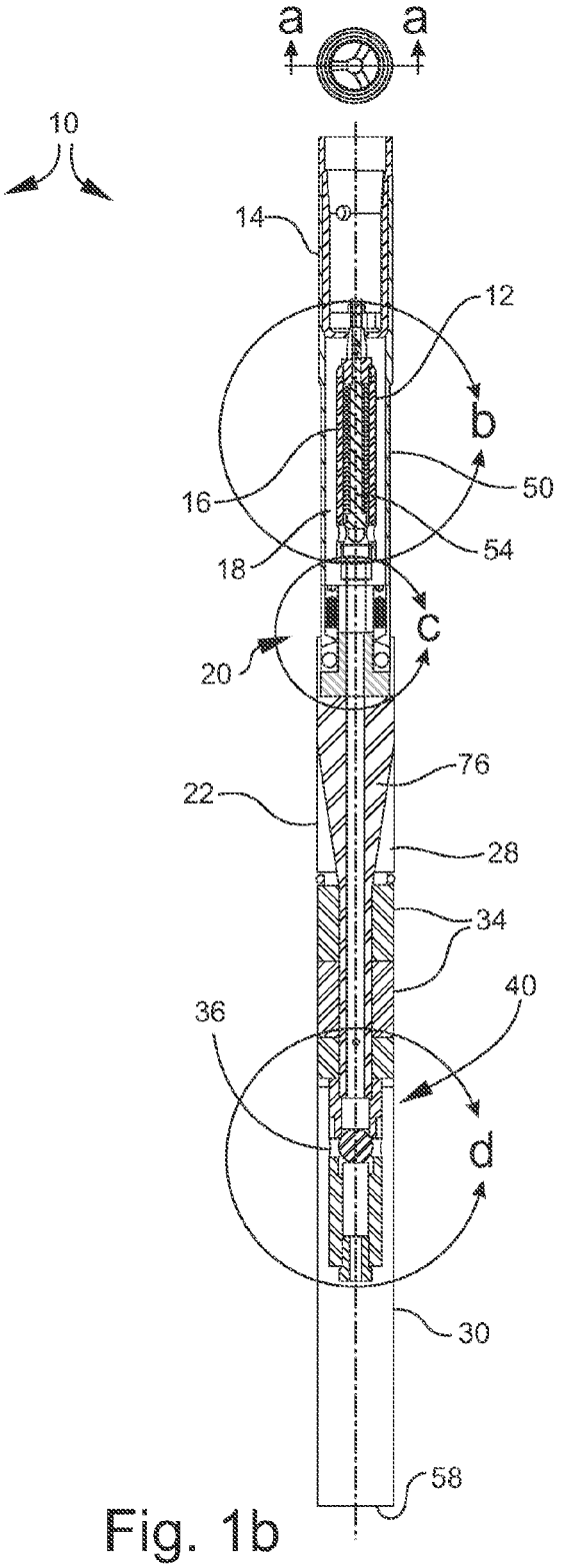
FIG. 1*b* is a sectional view of the tool of FIG. 1*a;*
Figure 1C:
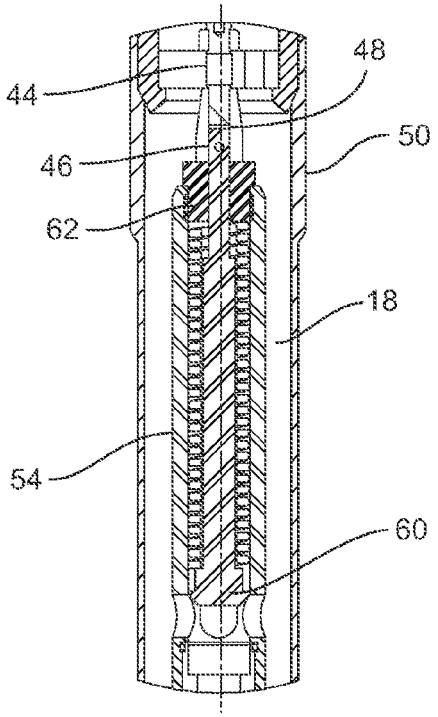
FIG. 1*c* is a detailed view of part of the tool of FIG. 1*a;*
Figure 1F:
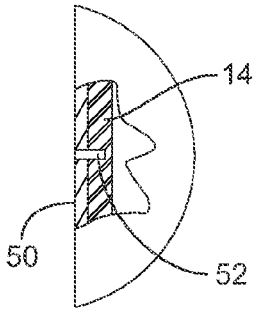
FIG. 1*f* is a detailed view of part of the tool of FIG. 1*a;*

In the following description, an exemplary tool according to the present invention is identified by the numeral 10. Referring to FIGS. 1*a* and 1*b*, the tool 10 generally comprises a body 12, a passage 18 extending through the tool 10, a locking component 20 for securing the tool 10 in a desired position downhole, an outer sleeve 22 operable in relation to the locking means, and a housing 50. The components are made of material well known to those skilled in the art, and the components are threadably engaged in a manner well known in the art of drilling technologies.

Turning to FIGS. 1*c*, 1*f*, 2*a* to 2*c* and 3*a*, the body 12 comprises an upper member 14 and a lower member 16 within the housing 50. The upper member 14 is configured for slidable movement within the housing 50, but it is secured in place by a housing shear pin 52 until action is taken to disconnect the upper member 14 from the lower member 16 (as will be described below), at which point the housing shear pin 52 would rupture. The upper member 14 has a downwardly projecting portion 44, and the lower member 16 has a corresponding upwardly projecting portion 46, the two portions 44, 46 connected by means of a body shear pin 48 until action is taken to disconnect the upper member 14 from the lower member 16 (as will be described below), at which point the body shear pin 48 would rupture. The upper member 14 is also provided with a cavity 82 sized and configured to receive and retain a plug 38 having ribs 80. The plug 38 is to be inserted into the tool 10 after injection of a desired volume of cementitious material, and the ribs 80 are configured to contact adjacent walls and hold the plug 38 in place.

Turning now to FIGS. 2*a* to 2*c*, 3*a*, 3*b*, 3*c* and 3*d*, the lower member 16 is configured for axial movement within the housing 50. While it is held in an upward position by means of the body shear pin 48, the lower body 16 is under a downward pressure by means of the spring 54. The spring 54 is situated between the upper block 62 and the lower blocking end 60 of the lower member 16, and is compressed while the body shear pin 48 is intact and the upper and lower members 14, 16 are connected. Upon rupture of the body shear pin 48 (which will be described below), the spring 54 presses against the block 62 and the blocking end 60, driving the lower member 16 in a downward direction. The effect of this movement is to cause the blocking end 60 to block a portion of the passage 18, such that cementitious material cannot flow to the lower parts of the tool 10.

A rod 42 or similar stem or string can be used to lower the tool 10 into position within the hole, as will be known to those skilled in the art. The rod 42 is connected to the upper member 14 in a conventional manner, such as a threaded connection. The rod 42 is used to both lower the tool 10 into position within the wellbore and to lift the upper member 14 out of the wellbore. In some embodiments, the rod 42 can also be hollow and then used to supply cementitious material to the passage 18, but in the illustrated embodiment the rod 42 is solid.

A description of exemplary locking means is provided in the following, but those skilled in the art would recognize that other conventional locking means can be used instead. Various mechanical locking means have been developed for use with cementing tools, but the below locking means, taught in detail in Canadian Patent Application No. 2,790,548 and corresponding U.S. patent application Ser. No. 14/033,754 to the present inventor, is preferred for use with the present invention as it can be deployed simply by pushing downwardly using the rod 42, with no tool 10 rotation required. The tool 10 of the exemplary embodiment is configured to be permanently secured inside a drill string, and so the desired location in this case would be the bottom of the hole at the desired drilling depth, with the downhole obstacle being the upper surface of the drill bit; however, it would be obvious to one skilled in the art that other configurations and other drilling applications are possible within the scope of the invention.

Figure 1G:
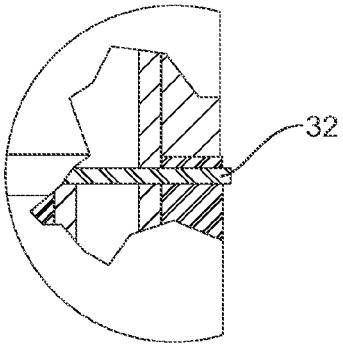
FIG. 1*g* is a detailed view of part of the tool of FIG. 1*a;*
Figure 1E:
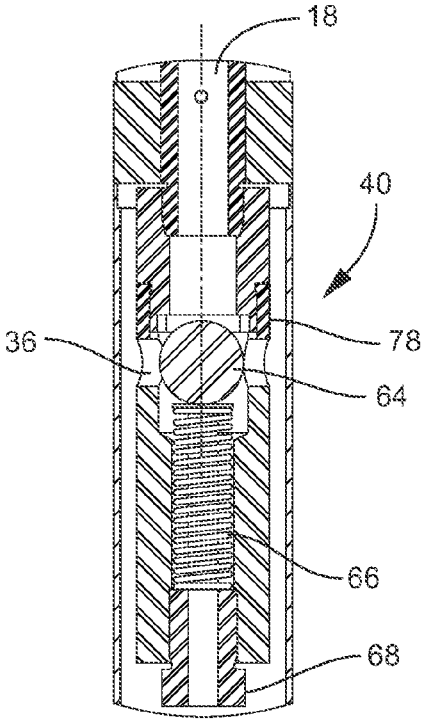
FIG. 1*e* is a detailed view of part of the tool of FIG. 1*a;*
Figure 1D:
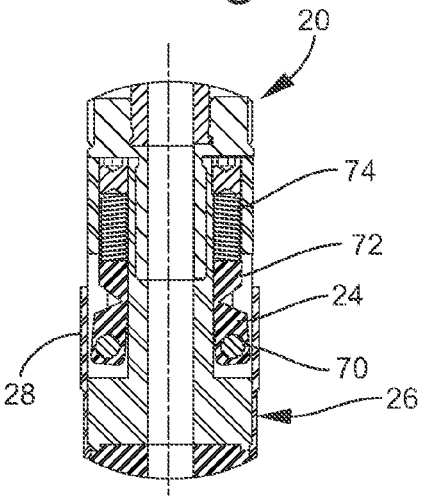
FIG. 1*d* is a detailed view of part of the tool of FIG. 1*a;*
Figures 2A, 2B, 2C:
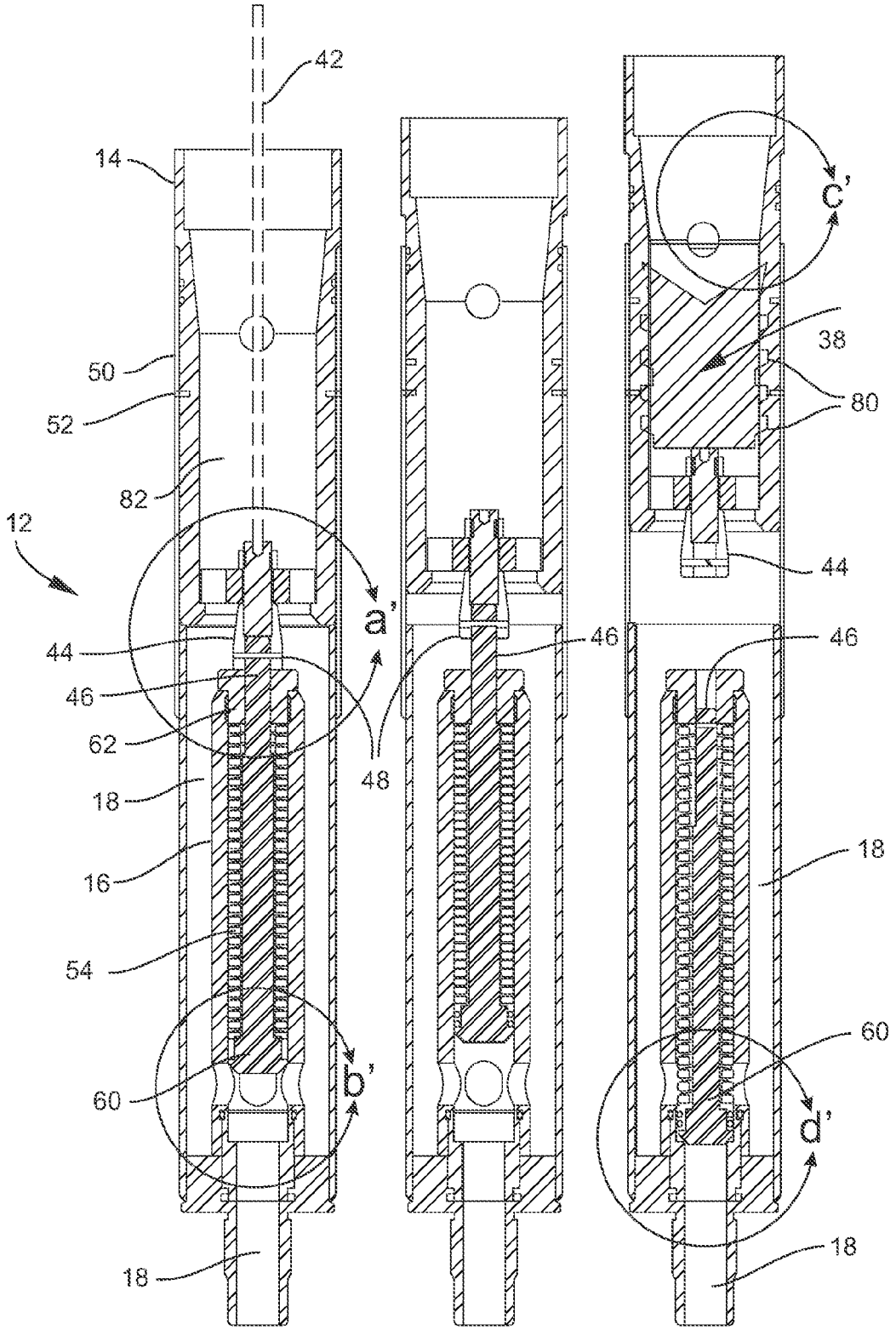
FIG. 2*a* is a sectional view of the upper portion of the tool of FIG. 1*a*, before rupturing of the body shear pin.
FIG. 2*b* is a sectional view of the upper portion of the tool of FIG. 1*a*, during initial lifting of the upper member but before rupturing of the body shear pin.
FIG. 2*c* is a sectional view of the upper portion of the tool of FIG. 1*a*, after rupturing of the body shear pin.
Figure 3C:
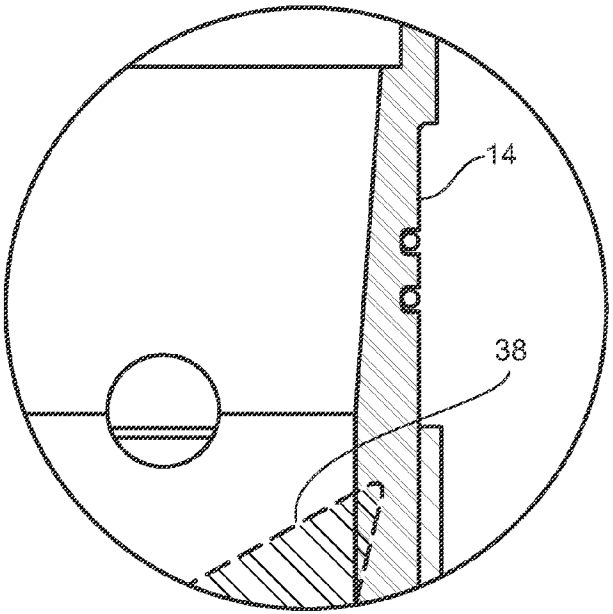
FIG. 3*c* is a detailed view of part of the tool of FIG. 1*a*.
Figure 3A:
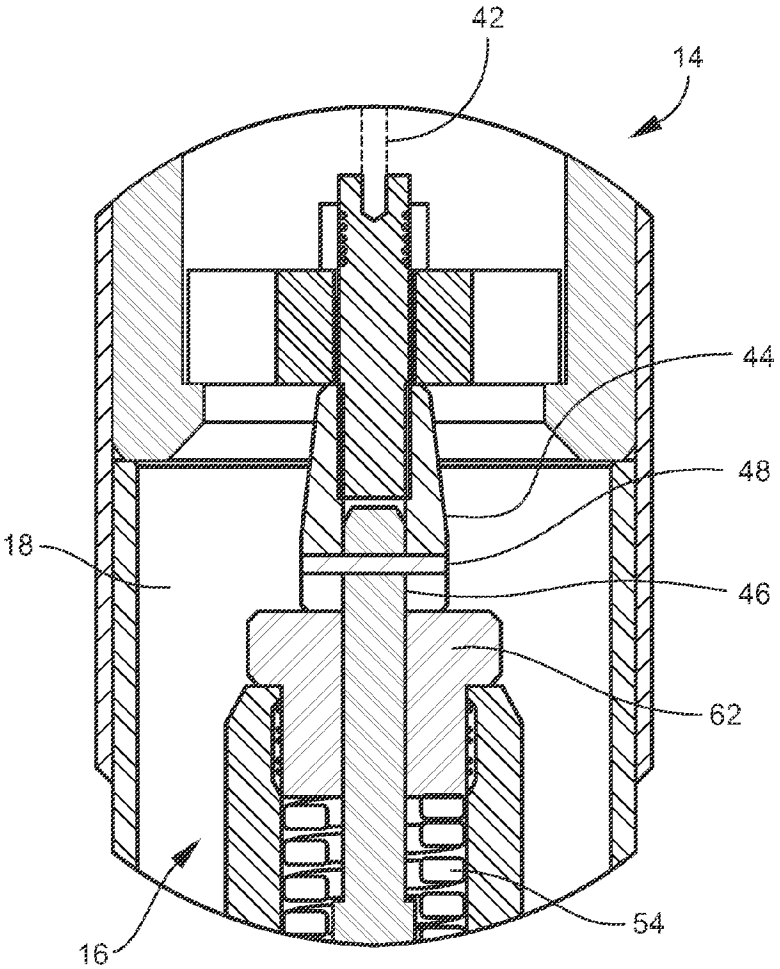
FIG. 3*a* is a detailed view of part of the tool of FIG. 1*a;*
Figure 3D:
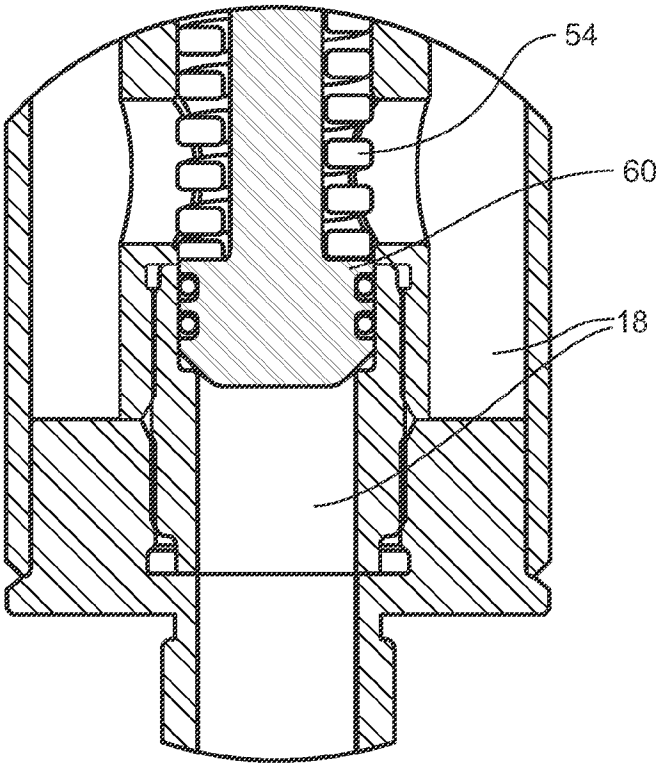
FIG. 3*d* is a detailed view of part of the tool of FIG. 1*a*.
Figure 3B:
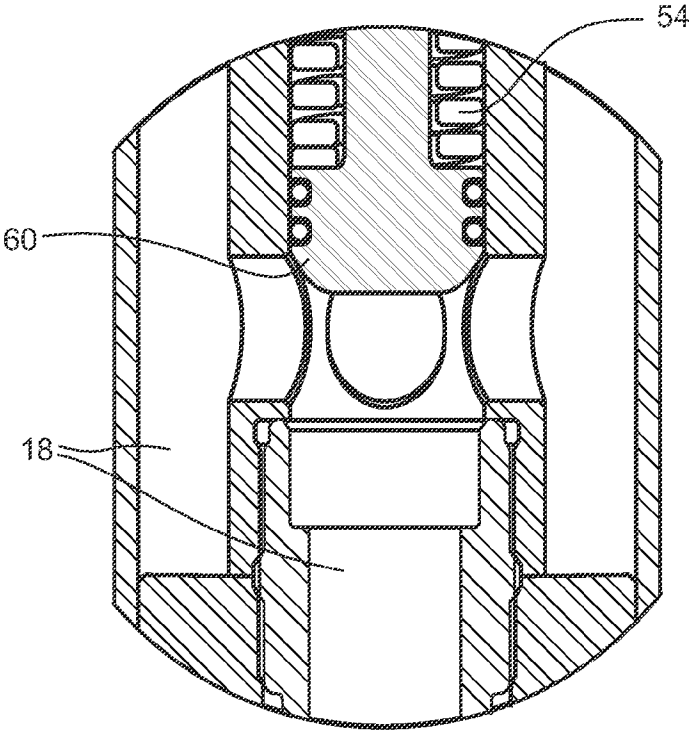
FIG. 3*b* is a detailed view of part of the tool of FIG. 1*a;*

The locking means involve the interaction of the outer sleeve 22 and the locking component 20. Turning to FIGS. 1*b*, 1*d* and 1*g*, the outer sleeve 22 comprises an upper sleeve 28 and a lower sleeve 30, the upper sleeve 28 disposed around the locking component 20 for movement relative thereto. The upper sleeve 28 is provided with guiding slots 56 for allowing axial movement but disallowing rotational movement of the upper sleeve 28. The lower sleeve 30 extends downwardly past the lowest extent of the internal components of the tool 10, such that the lower sleeve 30 is the part of the tool 10 that contacts the downhole obstacle.

The locking component 20 comprises four locking members 24 (two of which are visible in FIG. 1*d*, the four locking members 24 being disposed at equal distances around the tool 10). The locking members 24 are pivotally mounted on the locking component 20 by means of pivot pins 70, such that the locking members 24 are rotatable from a first position shown in FIG. 1*d* to a second position rotated away from the long axis of the tool 10. The locking members 24 are biased toward the second position by means of wedges 72 which are driven downwardly by springs 74. The wedges 72 are driven downwardly by the springs 74, but the angled contact face of the wedge 72 imparts an outward rotation of the locking member 24.

In the position shown in FIG. 1*d*, however, the locking members 24 cannot rotate outwardly due to the presence of the upper sleeve 28. As illustrated in FIGS. 1*a* and 1*d*, the upper sleeve 28 is disposed in a generally downward orientation, such that apertures 26 in the upper sleeve 28 are positioned below the locking members 24. When the apertures 26 are not aligned with the locking members 24, the locking members 24 cannot extend through the upper sleeve 28 for engagement with the wellbore or inner surface of the drill string. However, the upper sleeve 28 can be raised relative to the locking component 20, such that the apertures 26 align with the locking members 24 and allow the locking members 24 to extend through the upper sleeve 28. The mechanism for allowing the upper sleeve 28 to move upwardly relative to the locking component 20 and allow the locking members 24 to pass through the apertures 26 is described below.

Turning now to FIGS. 1*a* and 1*b*, the lower sleeve 30 is shown extending downwardly to cover the lowermost internal components of the tool 10. As the lower sleeve 30 is the lowest part of the tool 10 when installed in a drill string, it is obvious that the lower end 58 of the lower sleeve 30 will be the part of the tool 10 that contacts the downhole obstacle (in the exemplary case a drill bit). The lower sleeve 20 is secured in place by a sleeve shear pin 32. Deformable rubber sleeves 34 are positioned between the upper and lower sleeves 28, 30, and the rubber sleeves 34 are positioned around a lower portion of an angled body 76, which can be seen in FIG. 1*b*.

The angled body 76 extends between the locking component 20 and a backflow preventer 40, and allows passage of cementitious material to the drill bit. Turning to FIG. 1*e*, the backflow preventer 40 comprises a ball chamber that houses a ball 64 which allows cementitious material to pass from the passage 18 through four equally radially disposed openings 36 and out of the tool 10. In the event of backflow into the chamber, the ball 64 instead presses upwardly against a hardened seat ring 78 and thereby prevents backflow into the passage 18. The ball 64 is biased upwardly by means of a spring 66, which spring 66 is controlled by means of a pressure-adjusting screw 68.

Use of the tool 10 will now be described. When a user wishes to cement a drilled borehole, the tool 10 is threadably connected the rod 42 and then lowered into the interior of the drill string. When the tool 10 reaches the end of the drill string, the lower end 58 of the lower sleeve 30 strikes the drill bit. As downward force continues to be applied to the tool 10, the central body of the tool 10 is pushed downward relative to the lower sleeve 30. This causes the sleeve shear pin 32 to rupture, allowing upward movement of the lower sleeve 30 relative to the central body of the tool 10. This upward movement is now applied to the rubber sleeves 34, the rubber sleeves 34 being pressed outwardly toward the inner surface of the drill string due to the angled surface of the angled body 76, thereby forming a seal against the drill string and preventing any backflow of cementitious material around the tool 10 and upwards within the drill string.

As the rubber sleeves 34 then push the upper sleeve 28 upwardly relative to the locking component 20, the upper sleeve 28 moves upwardly from the first position shown in FIG. 1*d*. When the apertures 26 accordingly move into position adjacent the locking members 24, the locking members 24 are outwardly biased through the apertures 26 and engage the inner surfaces of the drill string. The tool 10 is then secured within the drill string immediately above the bit, without the need to rotate the tool 10, and cementing can begin. Cementitious material is then injected into the passage 18, ultimately passing out the openings 36 and downwardly toward the bit, where it will pass through the bit and into the annulus between the drill string and borehole walls.

Once a volume of cementitious material has been injected that the user has determined will be adequate for the desired cementing activity, the plug 38 is sent downhole to the tool 10. Once the plug 38 reaches the tool 10, it presses into the cavity 82, where the ribs 80 seal, centralize and stabilize the plug 38. Once in position, the plug 38 prevents any material from passing through the tool 10 to the bit. In addition, the ball 64 presses upwardly against the hardened seat ring 78 to prevent backflow into the passage 18, while the rubber sleeves 34 prevent backflow around the outside of the tool 10.

With the cementing process complete and the tool 10 plugged, the rod 42 can be retrieved to surface, leaving the tool 10 behind in the secured position adjacent the bit. In conventional tools, a rod is threadably engaged with the cementing tool and accordingly must be unthreaded, causing a risk of unthreading of the drill string. In the exemplary embodiment, by contrast, no rotation of the rod 42 or tool 10 is required. Instead, the rod 42 is simply pulled straight uphole, exerting an upward force on the upper member 14 to which it is attached. The upward force puts pressure on the body shear pin 48, until the strength of the body shear pin 48 is overcome and it ruptures. Once the body shear pin 48 ruptures, the downwardly projecting portion 44 of the upper member 14 and the upwardly projecting portion 46 of the lower member 16 disconnect and separate, allowing upward slidable movement of the upper member 14 within the housing 50 and eventual release of the upper member 14 altogether. The rod 42 and upper member 14 can then be retrieved to surface. The plug 38 is in the upper member 14 that has been disconnected and retrieved, but the spring 54 acts to drive the now-released lower member 16 in a downward direction, blocking the passage 18 and thus plugging the tool 10.

As can be readily seen, then, there are numerous advantages provided by the present invention. First, a tool according to the present invention can be deployed and the rod recovered without rotation of the tool or risk of unthreading the drill string. Also, the tool can be deployed and the rod recovered in an in-place drill string, so no tripping out is required. The downwardly biased lower member also provides plugging functionality when the standard rubber plug has been brought uphole with the rod and the upper member.

The foregoing is considered as illustrative only of the principles of the invention. Thus, while certain aspects and embodiments of the invention have been described, these have been presented by way of example only and are not intended to limit the scope of the invention. The scope of the claims should not be limited by the exemplary embodiments set forth in the foregoing, but should be given the broadest interpretation consistent with the specification as a whole.

The invention claimed is:

1. A tool for use in cementing a wellbore, the tool comprising:

a body, the body comprising upper and lower members;

a passage for receiving and guiding cementitious material through the tool;

locking means configured to secure the tool within the wellbore when deployed;

the upper and lower members connected by means of a shear component, the shear component configured to rupture and allow disconnection of the upper and lower members; and the upper member configured for engagement with a rod for lowering the tool into place in the wellbore;

wherein after deployment of the locking means, lifting of the upper member by means of the rod causes the shear component to rupture and the upper and lower members to disconnect, allowing the upper member to be disconnected without rotating the tool and removed from the wellbore.

2. The tool of claim 1 further comprising an outer sleeve slidably disposed on the tool, wherein the locking means comprise outwardly-biased locking members configured to engage an inner surface of the wellbore, the outer sleeve comprising apertures configured to selectively align with the locking members;

wherein the outer sleeve is movable from a first downwardly disposed position to a second upwardly disposed position when the tool is lowered into the wellbore and contacts a downhole obstacle;

wherein the apertures and the locking members are out of alignment when the outer sleeve is in the first position, such that the locking members are held in a disengaged position by the outer sleeve; and wherein the apertures and the locking members are aligned when the outer sleeve is in the second position, such that the locking members extend through the apertures for engagement with the inner surface of the wellbore, thereby securing the tool in the wellbore.

3. The tool of claim 2 wherein the downhole obstacle is a drill bit and the locking members are configured to engage inner surfaces of a drill string within the wellbore.

4. The tool of claim 2 further comprising a locking component, wherein the locking members are pivotally mounted on the locking component.

5. The tool of claim 2 wherein the outer sleeve comprises an upper sleeve and a lower sleeve separated by a sleeve shear pin, the sleeve shear pin configured to rupture when the lower sleeve contacts the downhole obstacle and thereby allow upward movement of the upper sleeve into the second position.

6. The tool of claim 5 further comprising a deformable sleeve disposed between the upper sleeve and the lower sleeve, the deformable sleeve configured to move outwardly toward the inner surface of the wellbore for sealing engagement therewith when the upper and lower sleeves move upwardly into the second position.

7. The tool of claim 1 wherein the passage is disposed at least partly within the body.

8. The tool of claim 1 wherein the passage comprises at least one opening extending to an area external to the tool for release of cementitious material into the area.

9. The tool of claim 8 further comprising a backflow preventer to prevent backflow of cementitious materials through the at least one opening into the passage.

10. The tool of claim 1 wherein the upper member is configured to receive and retain a plug to terminate supply of the cementitious material to the passage.

11. The tool of claim 1 wherein the rod is hollow for supplying cementitious material to the passage.

12. The tool of claim 1 wherein the upper member comprises a downwardly projecting portion, the lower member comprises an upwardly projecting portion, and the shear component comprises a body shear pin passing through the downwardly projecting portion and the upwardly projecting portion.

13. The tool of claim 1 further comprising a housing, the upper and lower members disposed within the housing, the upper member secured within the housing by means of a housing shear pin, the housing shear pin configured to rupture when the shear component ruptures and the upper and lower members are disconnected.

14. The tool of claim 1 wherein the lower member is secured in a first position by the shear component when unruptured and biased toward a second position by biasing means;

wherein when the lower member is in the first position the passage is unblocked by the lower member; and wherein when the shear component ruptures the lower member moves to the second position and the passage is blocked by the lower member, thereby blocking flow of the cementitious material.

15. A method for cementing a wellbore, wherein the method comprises the steps of:

a. providing a tool comprising a body, a passage and locking means, the body comprising upper and lower members connected by a shear component;

b. connecting a rod to the upper member;

c. lowering the tool into the wellbore by means of the rod connected to the upper member;

d. securing the tool at a desired depth within the wellbore by means of the locking means;

e. injecting cementitious material through the passage, such that the cementitious material passes out of the tool and into the wellbore;

f. pulling up on the rod to lift the upper member, causing the shear component to rupture and the upper and lower members to disconnect without rotating the tool; and g. removing the upper member from the wellbore.

16. The method of claim 15 wherein the tool is lowered into a drill string in the wellbore, such that the locking means engage inner surfaces of the drill string and the cementitious material passes through the tool and out of the drill string and travels upwardly in the annulus between the drill string and the wellbore.

17. The method of claim 15 comprising the further step after step e of inserting a plug into the upper member to prevent cementitious material from entering the passage.

18. The method of claim 15 further comprising biasing the lower member toward a second position but securing the lower member in a first position by the shear component when unruptured, whereas in the first position the passage is unblocked by the lower member, the method further comprising the step after step f of allowing the lower member to move to the second position and block the passage thereby blocking flow of the cementitious material.

* * * * *